US005181852A

United States Patent [19]

Dambach et al.

[11] Patent Number: 5,181,852

[45] Date of Patent: Jan. 26, 1993

[54] PROGRAMMABLE INPUT-OUTPUT ELECTRICAL CONNECTOR

[75] Inventors: Philip J. Dambach, Naperville; Jerry A. Long, Elgin; Stephen A. Sampson, Downers Grove, all of Ill.

[73] Assignee: Molex Incorporated, Lisel, Ill.

[21] Appl. No.: 809,627

[22] Filed: Dec. 16, 1991

[51] Int. Cl.[5] ..... H01R 29/00

[52] U.S. Cl. ..... 439/52; 439/66; 439/69; 439/70; 439/82; 439/591

[58] Field of Search ..... 439/66, 68–71, 439/50–52, 82, 131, 591

[56] References Cited

U.S. PATENT DOCUMENTS

| | | | |
|---|---|---|---|
| 4,199,209 | 4/1980 | Cherian et al. | 439/591 |
| 4,220,383 | 9/1980 | Scheingold et al. | 439/71 |
| 4,362,353 | 12/1982 | Cobaugh et al. | 439/70 |
| 4,494,807 | 1/1985 | Cosmo | 439/68 |
| 4,504,887 | 3/1985 | Bakermans et al. | 439/71 |
| 4,511,197 | 4/1985 | Grabbe et al. | 439/69 |
| 4,575,175 | 4/1986 | Wilson . | |
| 4,623,207 | 11/1986 | Sasaki et al. . | |
| 4,684,184 | 8/1987 | Grabbe et al. | 439/71 |
| 4,688,864 | 8/1987 | Sorel | 439/69 |
| 4,710,134 | 12/1987 | Korsunsky | 439/70 |
| 4,898,539 | 2/1990 | Glover et al. | 439/81 |
| 4,906,194 | 3/1990 | Grabbe | 439/66 |
| 4,927,369 | 5/1990 | Grabbe et al. . | |

*Primary Examiner*—Paula A. Bradley
*Attorney, Agent, or Firm*—A. A. Tirva

[57] ABSTRACT

An electrical terminal is interposed between first and second opposing conductive surfaces. The terminal includes an intermediate support portion and first and second spring contact portions projecting from the intermediate support portion for respectively engaging the first and second opposing conductive surfaces. Complementary interengaging latches are provided between at least one of the first and second spring contact portions and the intermediate portion for holding the one spring contact portion out of engagement with the respective conductive surface. The electrical terminal is disclosed mounted within a connector housing by a floating mount to afford limited movement of the terminal relative to the connector housing.

14 Claims, 3 Drawing Sheets

PROGRAMMABLE INPUT-OUTPUT ELECTRICAL CONNECTOR

FIELD OF THE INVENTION

This invention generally relates to the art of electrical connectors and, particularly, to an input-output electrical connector for electrically coupling a plurality of conductors with an electronic component or device and wherein terminals of the connector are operably programmable.

BACKGROUND OF THE INVENTION

There are many applications in the electronic industry, such as in copying machines, computers and the like wherein a plurality of conductors must be terminated to various electronic components to carry out various functions of a machine or apparatus. For instance, in a copying machine, control electronics are fed through data conductors or lines and power conductors or lines to various devices, such as motors, audible or visual indicators, or the like which perform the various functions of the machine, such as changing the reduction of the copying process, varying the numbers of copies, rendering audible or visual signals or indicia, and the like. Electronic components or devices, such as printed circuit boards, integrated circuit chips, headers or connectors must be coupled through electrical connectors to the power and data transmission conductors or lines.

In some applications for electrical connectors of the character described above, such as where the electrical connector may be designed to couple data transmission lines or conductors to a printed circuit board, conventional circuit traces on the board may interconnect with an integrated circuit chip, for example. Programmable contact strips often are provided to program the integrated circuit chip to whatever electronic configuration is in a particular machine. The strip is provided with a plurality of contacts which can be selectively bent or otherwise deformed so that they do not engage particular circuit traces on the printed circuit board. In essence, the programmable strip tells the integrated circuit chip to perform various electronic functions by selectively shorting out circuit traces on the printed circuit board. In this manner, a generic integrated circuit chip can be provided and simply programmed within the connector assembly.

The present invention is directed to such programming capabilities or systems wherein the actual input-output terminals themselves, which interconnect the printed circuit board with a second printed circuit board or with discrete conductors, are provided with additional programming means.

SUMMARY OF THE INVENTION

An object, therefore, of the invention is to provide a new and improved input-output electrical connector for electrically coupling a plurality of conductors with an electronic component or components and which includes novel terminals or contacts which are operably programmable.

In the exemplary embodiment of the invention, generally, an electrical terminal is disclosed for interposition between first and second opposing conductive surfaces. The terminal includes an intermediate support portion and first and second spring contact portions projecting from the intermediate support portion for respectively engaging the first and second opposing conductive surfaces. The invention contemplates the provision of complementary interengaging latch means between at least one of the first and second spring contact portions and the intermediate portion for holding the one spring contact portion out of engagement with the respective conductive surface.

The invention also contemplates an electrical connector incorporating terminals described above.

As disclosed in the preferred embodiment, each spring contact portion of the terminal includes a spring arm bent back upon itself and defining a contact area near a free end thereof. The latch means are located near a base of the spring arm of the at least one spring contact portion. The latch means comprise a latch tongue projecting from the respective spring arm spaced inwardly from the free end thereof and a latch tongue receiving means near the base thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
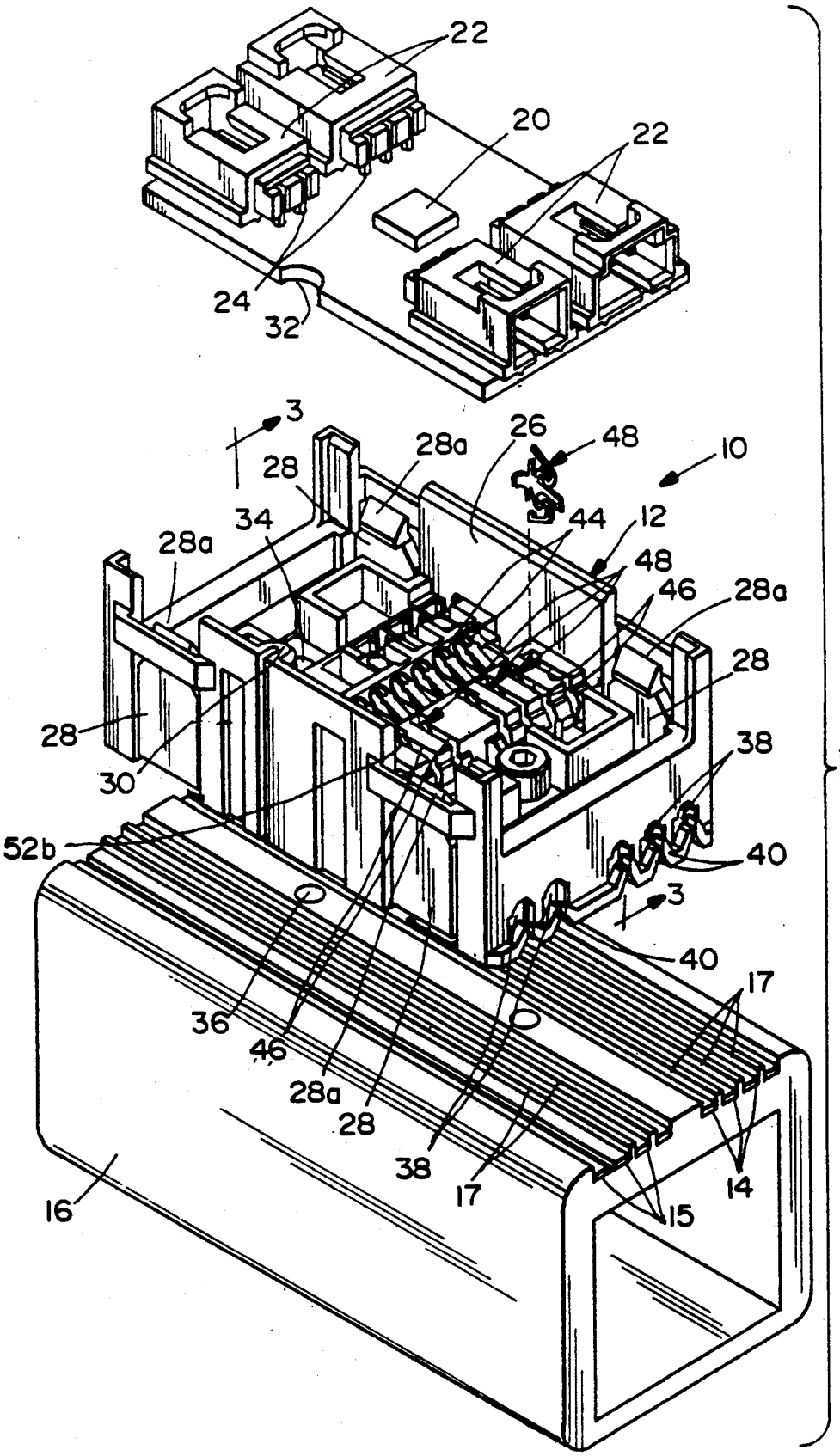
FIG. 1 is an exploded perspective view of an electrical connector assembly embodying the terminals of the invention in conjunction with a printed circuit board assembly and a frame having surface or inlaid conductors thereon.

Referring to the drawings in greater detail and first to FIG. 1, an electrical connector assembly generally designated 10, is shown to include a housing, generally designated 12. The electrical connector assembly is an input-output connector for coupling a plurality of conductors with an electronic component. As illustrated in FIG. 1, a plurality of surface mounted conductors 14 and 15, are provided on a frame 16. The conductors actually are inlaid within grooves 17 on top of the frame. Also, as illustrated, the array of conductors may include data transmission conductors 14 and power transmission conductors 15. The electronic component is shown in the form of a conventional printed circuit board 18 having circuit traces thereon. An integrated circuit chip 20 is mounted on top of the printed circuit board, and a pair of header connectors 22, having terminal pins 24, are mounted on top of the printed circuit board at each end thereof. Generally, housing 12 mounts terminals for coupling data and power transmission lines 14 and 15, respectively, to the circuit traces on printed circuit board 18.

The connector assembly described above can be used for distributing power and data through a copying machine, as an example. Control electronics from a control station run through the machine in data and power transmission lines 14 and 15, respectively. The connector terminates the lines to circuit traces on printed circuit board 18 and integrated circuit chip 20 distributes the power and data to various devices in the machine through header connectors 22 which receive complementary connectors (not shown) electrically coupled to various devices such as motors, audible and visual indicating means, and the like. For instance, the control electronics may include an actuator to change the degree of reduction of the copying machine from an original copy sheet. The electronic chip will tell a motor on the machine its respective function through one of the header connectors 22 through a complementary connector leading to the particular motor.

Figure 2:
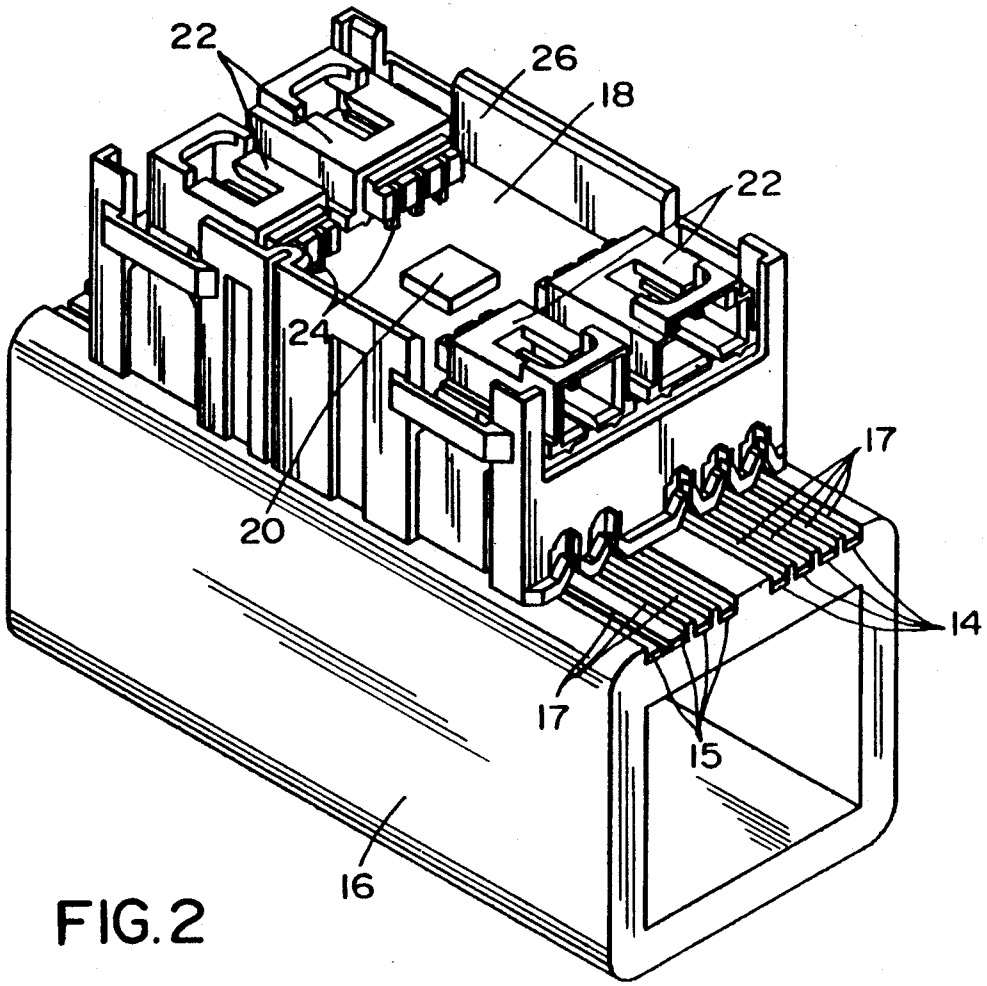
FIG. 2 is a perspective view of the electrical connector assembly of FIG. 1 in assembled condition and terminated to the frame.

More specifically, housing 12 is recessed in the top thereof to define a pocket 26 for receiving printed circuit board 18. The printed circuit board is shown in FIG. 2 disposed within the pocket. The housing is integrally molded of plastic material, such as glass filled polyester, and includes four integrally molded latch arms 28 having hook portions 28*a* whereby the hook portions snap over the top of printed circuit board 18 when fully seated in the housing as shown in FIG. 2. The housing may have an upwardly protruding polarizing rib 30 for seating in a polarizing notch 32 in one side of the printed circuit board. The housing also has a pair of holes 34 through which a pair of screws or bolts or other fastening means can be inserted to securely mount the housing to frame 16, as within internally threaded holes 36, for example.

Although integrally molded housing 12 is shown for use in conjunction with frame 16 and surface conductors 14 and 15, the housing has locating means in the form of a plurality of channels 38 for locating discrete insulated conductor wires should it be desirable to use the housing in conjunction with discrete conductors. The channels are partially closed by retention fingers 40 whereby the conductors or wires are retained in the channels by snapping the conductors past the retention fingers.

Figure 3:
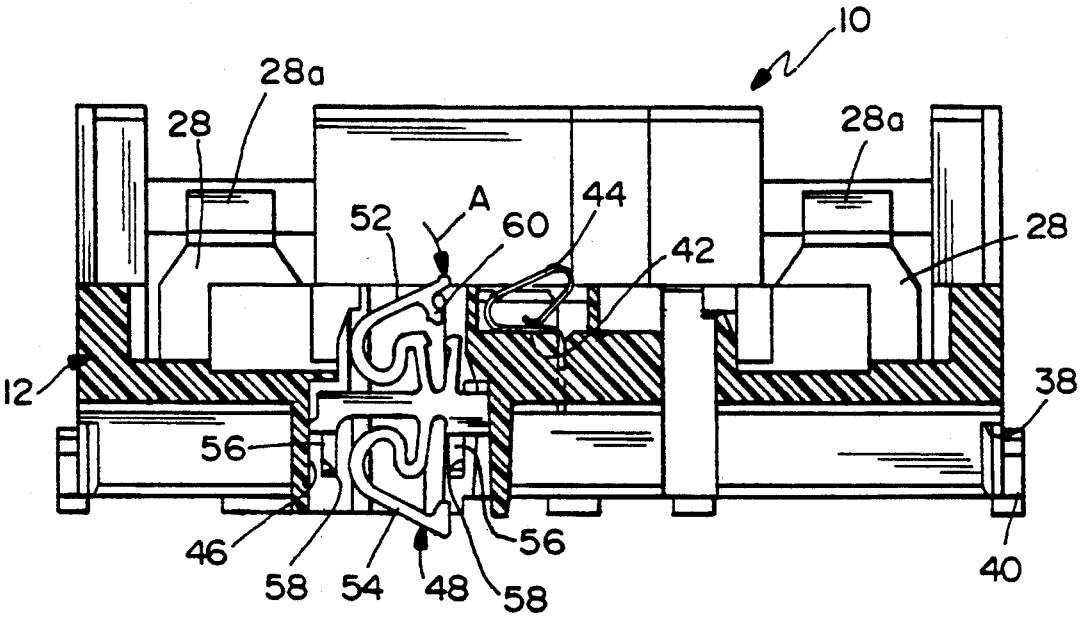
FIG. 3 is a vertical section through the housing of the electrical connector assembly taken generally along line 3—3 of FIG. 1.

Referring to FIG. 3 in conjunction with FIG. 1, in the particular application of electrical connector assembly 10 described herein, a programmable strip 42 is mounted in housing 12, with a plurality of upwardly projecting, cantilevered spring contact portions 44. As stated above, the electrical connector is designed to couple data transmission lines or conductors to printed circuit board 18. Conventional circuit traces on the printed circuit board interconnect with integrated circuit chip 20. Programmable strip 42, 44 is provided to program the integrated circuit chip to whatever configuration is in the machine. The strip is programmed by selectively bending one or more of cantilevered spring contact portions 44 downwardly so that they do not engage particular circuit traces on the underside of the printed circuit board. In essence, the programmable strip tells the integrated circuit chip to perform various electronic functions by selectively shorting out circuit traces on the printed circuit board. In this manner, a generic integrated circuit chip can be provided and simply programmed within the assembly.

Still referring to FIG. 3 in conjunction with FIG. 1, common housing 12 includes a plurality of receptacle means in the form of through passages 46 for receiving a plurality of terminals, generally designated 48, which are press-fit into the passages. The number of passages and terminals correspond to the number of data and power transmission conductors 14 and 15. Of course, it should be understood that this number is for illustration purposes only.

Figure 4:
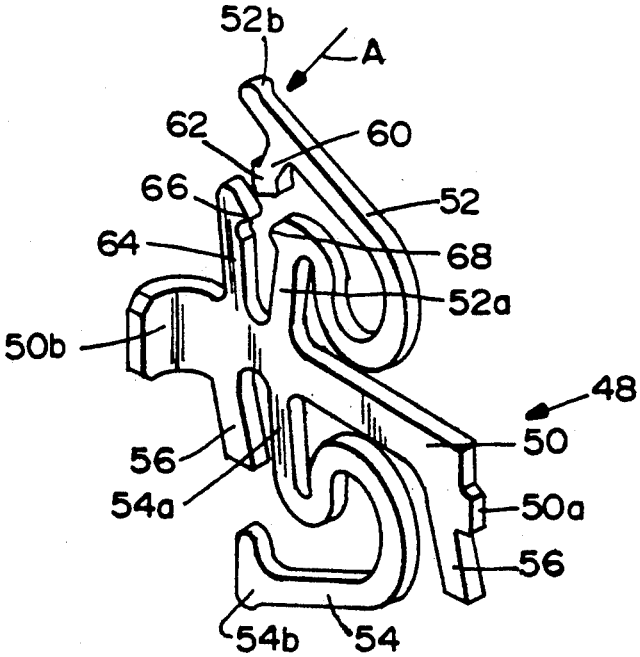
FIG. 4 is perspective view of one of the programmable terminals of the invention.

Referring to FIG. 4 in conjunction with FIG. 3, each terminal includes a generally rigid intermediate support portion 50 having a tab 50*a* and a flange 50*b* at opposite ends thereof for stablizing the terminal into a respective one of the passages 46 as shown by the one terminal in FIG. 3. First and second spring contact portions 52 and 54 project from intermediate support portion 50 by means of legs 52*a* and 54*a*, respectively. In essence, the spring contact portions 52 and 54 define spring arms with legs 52*a* and 54*a* acting as bases for anchoring the spring arms to intermediate support portion 50. The spring arms are bent back upon themselves and define contact areas 52*b* and 54*b* for the spring contact portions of the terminals. Contact area 52*b* of spring contact portion 52 is provided for engaging a circuit trace on printed circuit board 18, and contact area 54*b* on spring contact portion 54 is provided for surface engaging one of the conductors 14, 15 on frame 16. A pair of tabs 56 project downwardly from intermediate support portion 50 and are bent slightly at angles relative thereto for seating in recessed areas 58 (FIG. 3) in housing 12 within one side of a respective through passage 46. These tabs, along with flange 50 securely seat the respective terminal transversely within its respective through passage. However, it can be seen that the bottoms of recessed areas 58 are spaced from the bottoms of tabs 56 in FIG. 3. This allows for a degree of vertical "floating" movement between the terminals and the housing.

In addition to programmable strip 42, 44, the invention contemplates that as least one or more of terminals 48 also be provided with programming means to enhance the programmable capabilities of the connector assembly. To this end, a latch tongue 60 projects downwardly or inwardly from spring contact portion 52 toward intermediate support portion 50 of the terminal. The tongue has an enlarged head portion 62 on the distal end thereof. A latching leg 64 projects upwardly from intermediate support portion 50 spaced from base leg 52*a*. Hook portions 66 and 68 of latching leg 64 and base leg 52*a*, respectively, project toward each other in an opposing manner to define a mouth or gap therebetween which is smaller than the cross dimension of head 62 on latch tongue 60. The terminal is a stamped and formed metal component. It can be seen that latching leg 64 and base leg 52*a* are considerably shorter than spring contact portion 52 and thereby provide a greater latching force than the resiliency of the spring contact portion. Therefore, when the spring contact portion is pushed downwardly in the direction of arrow "A" (FIGS. 3 and 4), head 62 will be held between the latching and base legs in a position so that it does not engage any particular circuit trace on the underside of printed circuit board 18.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical terminal for interposition between first and second opposing conductive surfaces, including an intermediate support portion and first and second spring contact portions projecting from the intermediate support portion for respectively engaging the first and second opposing conductive surfaces, wherein the improvement comprises complementary interengaging latch means between at least one of the first and second spring contact portions and the intermediate portion for holding the one spring contact portion out of engagement with the respective conductive surface.

2. An electrical terminal as set forth in claim 1, in combination with a housing having a passage for receiving the terminal and including complementary floating mounting means between the housing and the terminal to afford limited relative movement therebetween.

3. An electrical terminal as set forth in claim 1 wherein each said spring contact portions include a spring arm bent back upon itself and defining a contact area near a free end thereof.

4. An electrical terminal as set forth in claim 3, wherein said latch means are located near a base of the spring arm of the at least one spring contact portion.

5. An electrical terminal as set forth in claim 2, wherein said latch means comprise a latch tongue projecting from the respective spring arm spaced inwardly of the free end thereof and a latch tongue receiving means near the base thereof.

6. An electrical terminal as set forth in claim 1, wherein said at least one of the first and second spring contact portions include a spring arm bent back upon itself and defining a contact area near a free end thereof, with latch means located near a base of the spring arm.

7. An electrical terminal as set forth in claim 6, wherein said latch means comprise a latch tongue projecting from the spring arm spaced inwardly from the free end thereof and a latch tongue receiving means near the base thereof.

8. An electrical connector including a housing having a plurality of through passages, a plurality of electrical terminals mounted in the passages for interposition between first and second opposing conductive surfaces, each terminal including an intermediate support portion and first and second spring contact portions projecting from the intermediate support portion for respectively engaging the first and second opposing conductive surfaces, wherein the improvement comprises each terminal having complementary interengaging latch means between at least one of the first and second spring contact portions and the intermediate portion for holding the one spring contact portion out of engagement with the respective conductive surface, whereby the connector can be programmed by latching a selective one or more of the spring contact portions of the terminals.

9. An electrical connector as set forth in claim 8, wherein said passages for receiving the terminals include complementary floating mounting means between the housing and the terminals to afford limited relative movement therebetween.

10. An electrical connector as set forth in claim 8, wherein each said spring contact portion of each terminal includes a spring arm bent back upon itself and defining a contact area near a free end thereof.

11. An electrical connector as set forth in claim 10, wherein said latch means are located near a base of the at least one spring contact portion.

12. An electrical connector as set forth in claim 11, wherein said latch means comprise a latch tongue projecting from the respective spring arm spaced inwardly of the free end thereof and a latch tongue receiving means near the base thereof.

13. An electrical connector as set forth in claim 8, wherein said at least one of the first and second spring contact portions include a spring arm bent back upon itself and defining a contact area near a free end thereof, with latch means located near a base of the spring arm.

14. An electrical connector as set forth in claim 13, wherein said latch means comprise a latch tongue projecting from the spring arm spaced inwardly from the free end thereof and a latch tongue receiving means near the base thereof.

* * * * *